US005349756A

United States Patent [19]

Davenport

[11] Patent Number: 5,349,756

[45] Date of Patent: Sep. 27, 1994

[54] SURVIVAL SAW

[76] Inventor: Le Roi D. Davenport, 948 E. 7th Ave., Broomfield, Colo. 80020

[21] Appl. No.: 116,521

[22] Filed: Sep. 7, 1993

[51] Int. Cl.[5] ..... B21D 39/00; B27B 21/00

[52] U.S. Cl. ..... 30/506; 30/512

[58] Field of Search ..... 30/506, 512, 519, 514

[56] References Cited

U.S. PATENT DOCUMENTS

| | | | |
|---|---|---|---|
| 1,442,609 | 1/1923 | Greig | 30/512 X |
| 2,734,536 | 2/1956 | Harper | 30/506 |
| 4,328,848 | 11/1982 | Miller | 145/33 R |
| 4,637,141 | 1/1987 | Allen | 30/512 |
| 4,779,345 | 10/1988 | Pooley | 30/506 |

OTHER PUBLICATIONS

Mountain Rat Enterprises Advertising Brochure.

Sears, Roebuck and Co. "Craftsman Flush Cutting Hack Saw" Model 93559 product wrapper.

*Primary Examiner*—Douglas D. Watts
*Attorney, Agent, or Firm*—Rick Martin

[57] ABSTRACT

A collapsible multipurpose hand saw is useful for camping, hunting, backpacking, tree pruning, wood cutting and like outdoor uses. The saw comprises two handles, a crosspiece, a saw blade, a tensioning strap and a tensioning rod. The hand saw is easily assembled and disassembled for storage. The saw blade can be mounted in a vertical or horizontal cutting position. The assembled hand saw can be combined with the case to form an emergency snow shovel. The hand saw has no small parts which are easily lost. The saw tensioning strap can be used to carry firewood bundles and can be used as an emergency sling or tourniquet. The handles and crosspiece can be used as emergency splints.

20 Claims, 7 Drawing Sheets

SURVIVAL SAW

FIELD OF THE INVENTION

The present invention relates to the field of collapsible tools. More particularly the invention relates to a multipurpose collapsible hand saw that can be combined with a carrying case for use as a snow shovel.

BACKGROUND OF THE INVENTION

Collapsible hand saws and collapsible shovels are known to be desirable equipment for hunters, campers, backpackers and the like. It is known to have a light weight saw useful for wood cutting, shelter construction and field dressing of game. Also known in the art is a light weight shovel useful for digging or scooping snow. Combination tools of various types are also known.

Heretofore, however, the advantages of a collapsible combination tool having ease of assembly and disassembly combined with trouble-free operation have not been seen.

In order to best view the advantages of the present invention a summary of the most relevant prior art follows below.

Mountain Rat Enterprises makes and sells a "Durango Saw." The Durango Saw 15 (FIGS. 1(*a*) and 1(*b*)) has handles 1 and 2, crosspiece 3, tensioning rod 4 and tensioning loop 5. Crosspiece extending projections 11 and 12 fit into handle holes 13 and 14 respectively. A saw blade 6 having mounting holes 16 and 17 fits into blade slots 7 and 8. The saw blade 6 is attached to handle 1 by inserting blade-holding pin 9 into mounting hole 18 and through saw blade mounting hole 16. The saw blade 6 is attached to handle 2 by inserting blade-holding pin 10 into mounting hole 19 and through saw blade mounting hole 17.

Problems with the Durango Saw 15 include lack of means for securing the tensioning rod 4. This allows the tensioning rod to be knocked loose when cutting wood or cutting into the chest cavity of large animals, thereby resulting in a lack of tension on the saw blade 6 and a lack of rigidity in the Durango Saw 15 as a whole. The Durango Saw 15 also lacks means for mounting the saw blade 6 horizontally for flush cutting. The Durango Saw 15 also has small blade-holding pins 9 and 10 for mounting the saw blade 6 which can be dropped and lost in the woods.

The present survival saw invention improves the Durango Saw 15 by providing a hole in the crosspiece to retain the tensioning rod and keep the tensioning rod out of the way when cutting. The present invention also improves the Durango Saw by providing for both vertical and horizontal mounting of the saw blade. The vertical handles of the present invention are beveled to separate bone and tissue when field dressing game. In addition, the tensioning strap can be used to carry firewood bundles and can be used as an emergency tourniquet or sling. The present invention has no small parts that can be easily lost. The survival saw can be combined with the case to form an emergency snow shovel.

SUMMARY OF THE INVENTION

The main object of the present invention is to provide a lightweight collapsible hand saw suitable for cutting wood and field-dressing game.

Another object of the present invention is to provide a carrying case that can be combined with the hand saw to make an emergency shovel suitable for scooping snow and building snow shelters.

Another object of the present invention is to provide a hand saw with saw blade mounts enabling both vertical and horizontal mounting of the saw blade. Horizontal mounting of the saw blade is particularly convenient for flush cutting, for cutting joints in logs and for planing bark from logs.

Another object of the present invention is to provide a tensioning strap for the saw adaptable for use in carrying firewood bundles.

Another object of the present invention is to provide a tensioning strap and handles suitable for emergency use as a tourniquet and splints by trained medical personnel.

Another object of the present invention is to provide a collapsible hand saw with no small pins or wing nuts which can easily be dropped and lost in the woods.

Another object of the present invention is to provide a hand saw with beveled vertical handles particularly suitable for the separation of tissue and bone when cutting game.

Another object of the present invention is to provide a crosspiece with a hole to retain the tensioning rod thereby keeping the tensioning rod out of the way during cutting and preventing the tensioning rod from coming loose resulting in a loss of tension to the saw blade.

Another object of the present invention is to provide an improved collapsible hand saw which is rigid when assembled and which enables the user to quickly change the saw blade 10 one suitable for cutting wood, meat or metal.

Another object of the present invention, while achieving the above stated objects, is to provide an improved survival saw which may be easily and simply assembled and easily disassembled and stored in a compact unit.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 1 (*b*) ms an exploded view of FIG. 1(*a*) with a partial cutaway (prior art).

FIG. 2(*b*) is an exploded view of FIG. 2(*a*) with partial cutaways.

FIG. 3 (*b*) is a front plan view of one of the survival saw handles.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 1A:
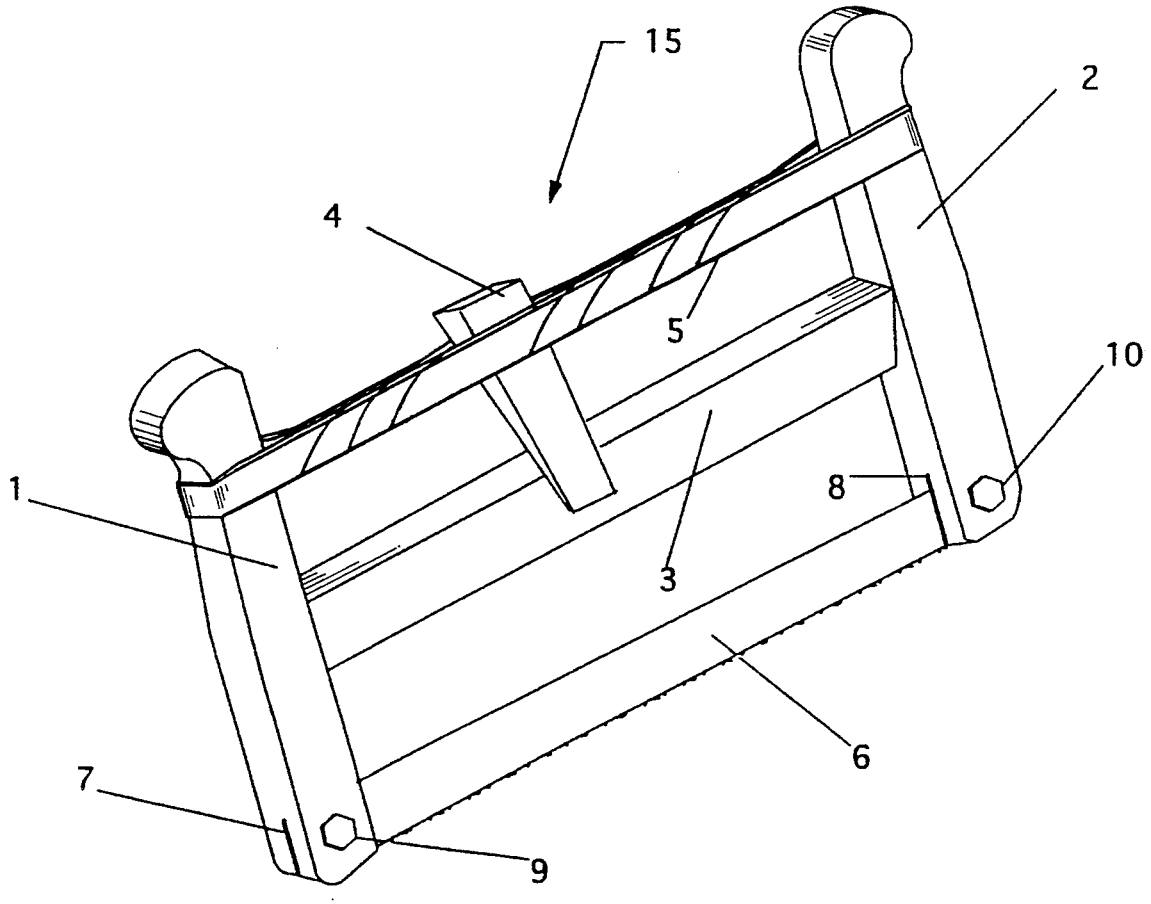
FIG 1(*a*) ms a top left front perspective view of the "Durango Saw" (prior art).
Figure 1B:
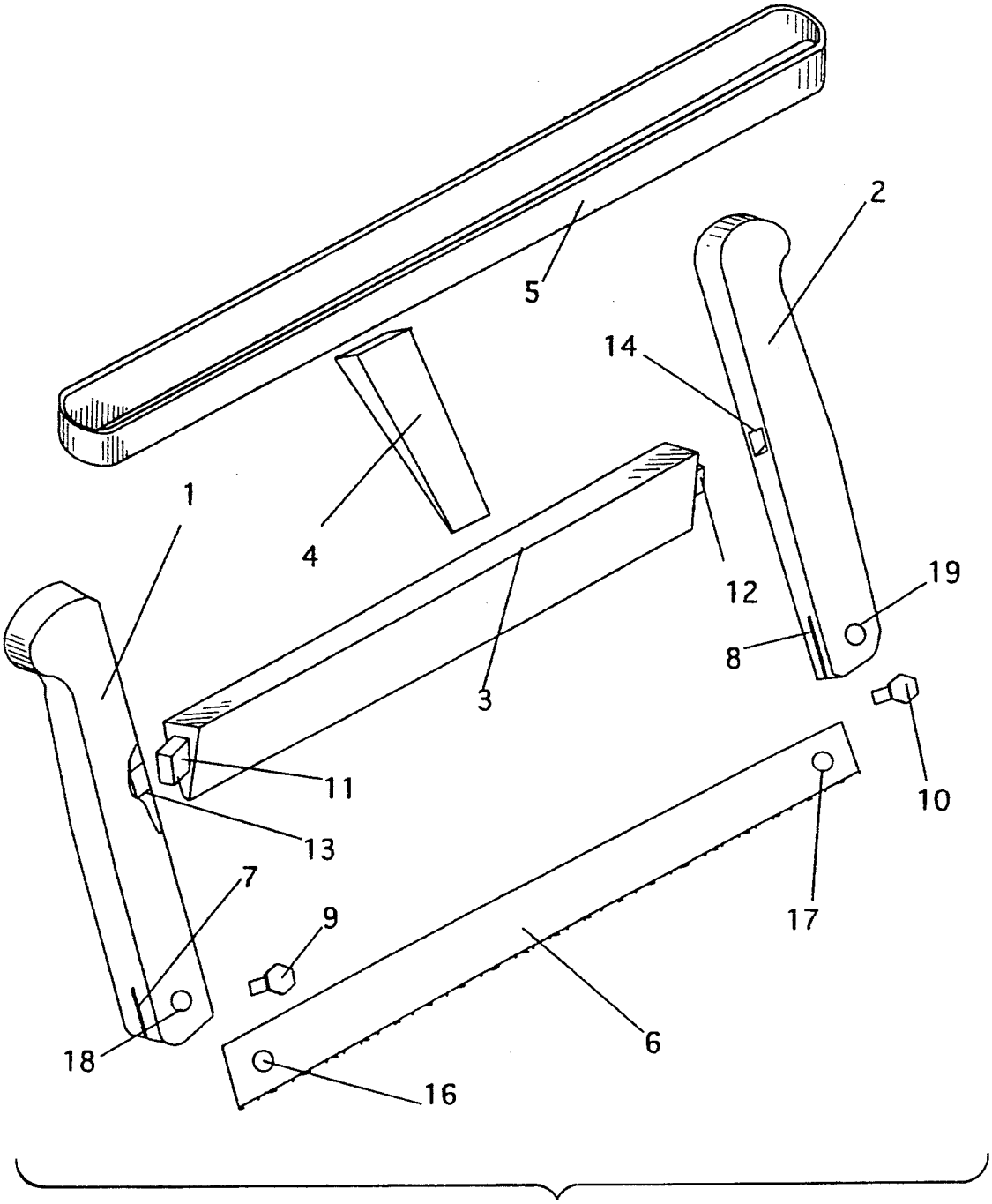
Figure 2A:
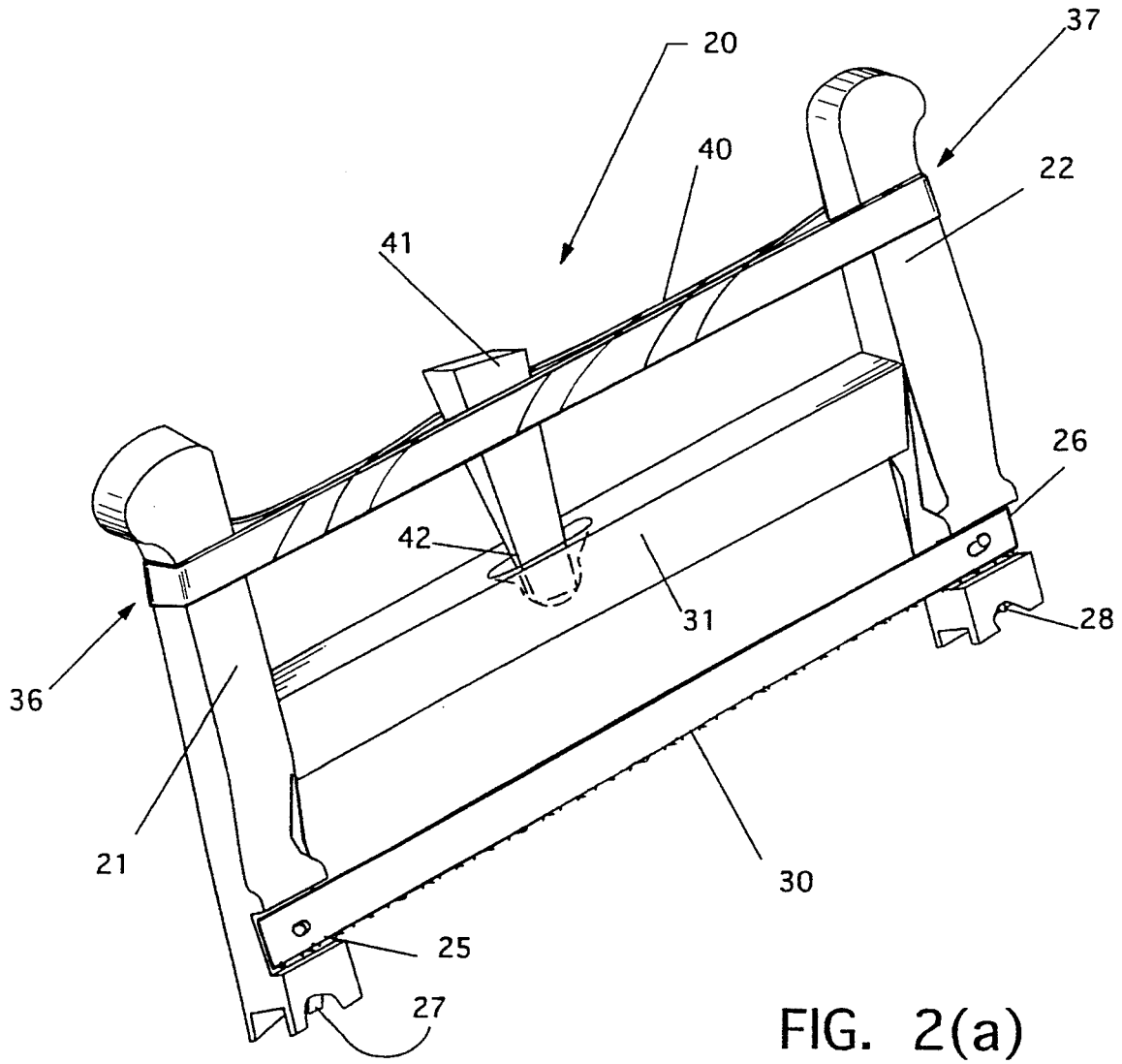
FIG. 2(*a*) is a top left front perspective view of the survival saw.
Figure 2B:
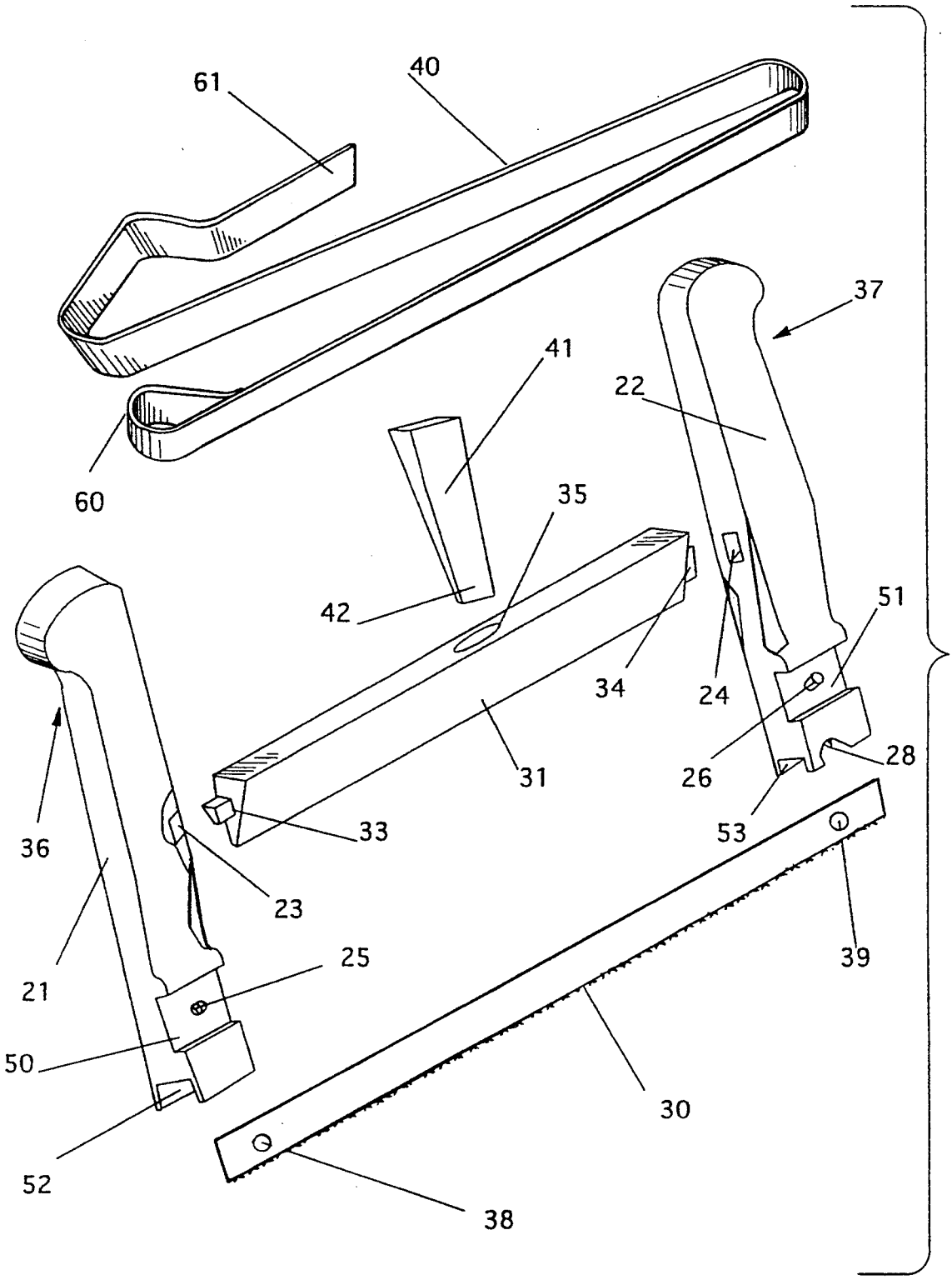

Referring first to FIGS. 2(*a*) and 2(*b*), the survival saw 20 has handles 21 and 22 having holes 23 and 24 respectively. Holes 23 and 24 may extend partially into the handles 21 and 22 or may extend through the handles 21 and 22 (not shown). Handles 21 and 22 have integral retaining pins 25, 27 and 26, 28 respectively. Crosspiece 31 has extending projections 33 and 34 which are fitted into holes 23 and 24 respectively. The extending projections 33 and 34 may be of any shape suitable to firmly hold the crosspiece-rectangular extending projections are shown. Saw blade 30 is fitted vertically into blade notches 50, 51 and the mounting holes 38 and 39 are fitted onto integral retaining pins 25 and 26 respectively for normal cutting. Saw blade 30 is fitted horizontally (FIGS. 4, 5, 6) into blade notches 52, 53 and the mounting holes 38 and 39 are fitted onto integral retaining pins 27 and 28 respectively for flush cutting or planing. The blade notches 50, 51, 52 and 53 and integral retaining pins 25, 26, 27 and 28 are positioned so that the saw blade 30 is fitted along the centerlines of handles 21 and 22. Retaining pins 25, 26, 27 and 28 are mounted at an 85° angle (5° from square) in an outwardly leaning direction in order to better retain the saw blade 30 under tension. It is known in the art that saw blade 30 may have various types of teeth to best cut wood or meat.

Tensioning strap 40 has a loop 60 at one end. The free end 61 is inserted through the loop 60 and the tensioning strap 40 is looped and wrapped around the upper ends 36 and 37 of handles 21 and 22 respectively. Tensioning rod 41 is inserted into the strands of tensioning strap 40 and twisted circularly so as to pull the upper ends 36, 37 toward one another, thereby tightly mounting saw blade 30 between integral retaining pins 25, 26 or alternatively between integral retaining pins 27, 28 for horizontal mounting of saw blade 30. The end 42 of tensioning rod 41 is then placed into crosspiece hole 35, which retains the tensioning rod 41 in place. The crosspiece hole 35 is preferably oval and beveled at the ends in order to allow easier insertion of the tensioning rod 41 when the rod is under tension from winding up tensioning strap 40. Consequently the saw blade 30 is placed under tension, and the survival saw 20 becomes rigid.

The handles 21 and 22, crosspiece 31 and tensioning rod 41 are preferably made of wood or a plastic or polymeric material for lightness and comfort in cold weather. Metal saws have been know to stick to the hands in extremely cold weather. Saw blade 30 and integral retaining pins 25, 26, 27 and 28 are preferably made of metal.

Figure 3A:
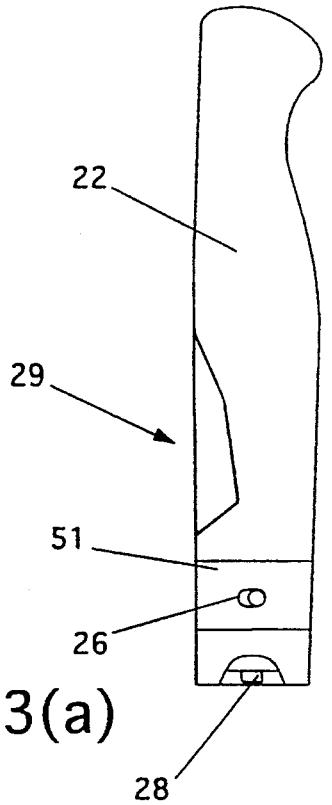
FIG. 3 (*a*) is a side plan view of one of the survival saw handles with a partial cutaway.
Figure 3B:
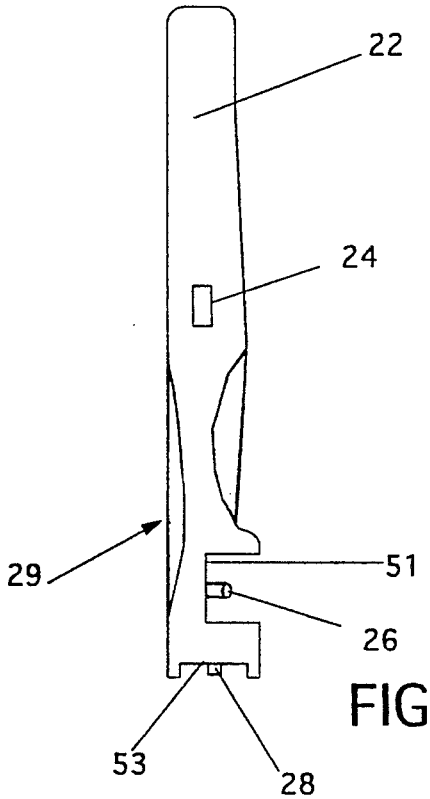

Referring next to FIGS. 3(*a*) and 3(*b*) the handle 22 is beveled toward the inside in grip area 29. This helps spread the chest cavity when using the survival saw to dress large game. Beveling grip area 29 also provides a more secure and comfortable grip on the survival saw. Handle 21 (not shown) is a mirror image of handle 22.

Figure 4:
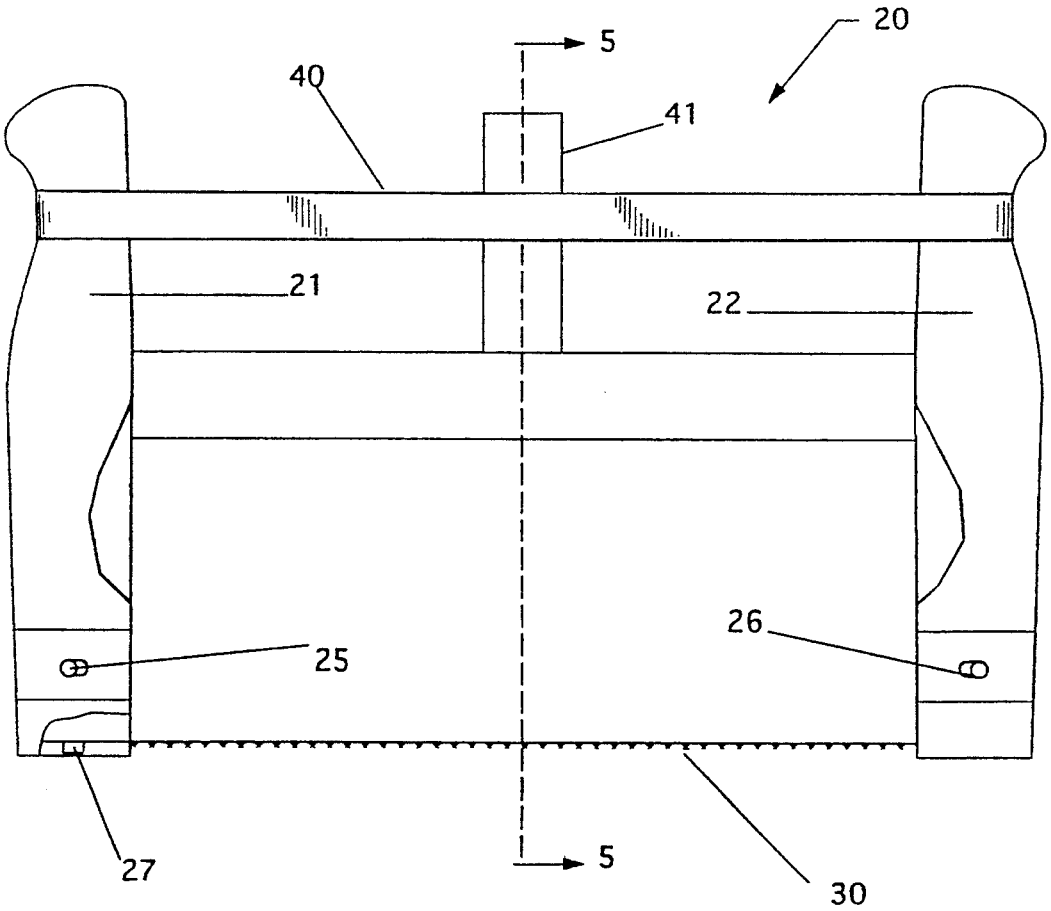
FIG. 4 is a front plan view of the survival saw with the saw blade in the horizontal flush cut position.
Figure 5:
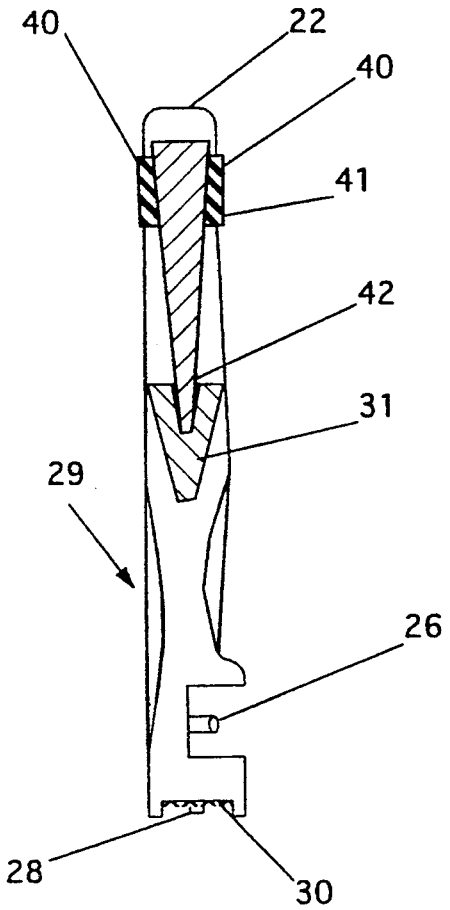
FIG. 5 is a sectional view taken along line 5—5 of FIG. 4.
Figure 6:
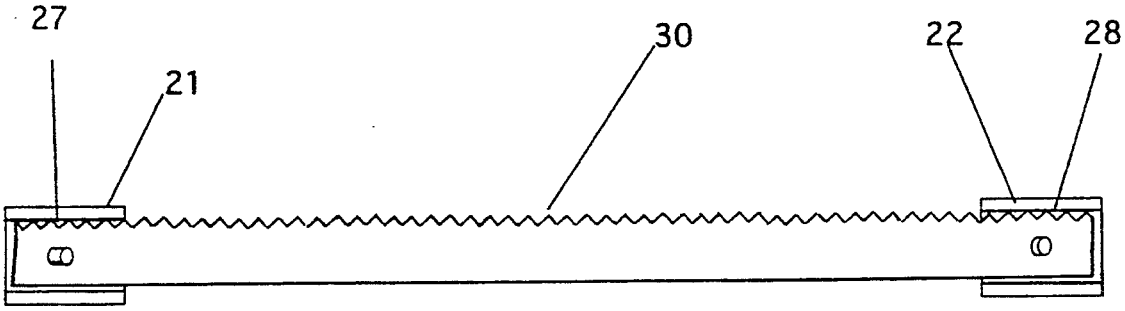
FIG. 6 is a bottom plan view of the survival saw with the saw blade in the flush cut position.

Referring next to FIGS. 4, 5 and 6 the survival saw 20 is shown with the saw blade 30 in the horizontal flush cutting position. The horizontal position is particularly suited for flush cutting branches off logs, for cutting joints into logs, for planing bark off logs and for cutting filets from large fish.

Figure 7:
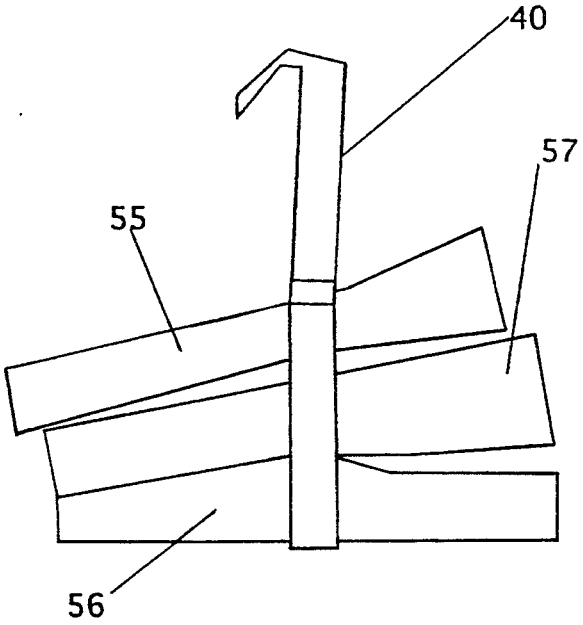
FIG. 7 is a front plan view of a firewood bundle secured by the tensioning strap.

Referring next to FIG. 7 the tensioning strap 40 is shown looped into a sling around logs 55, 56 and 57. The tensioning strap 40 is preferably made of a high strength natural or synthetic material (such as leather or polypropylene webbing) so as to be suitable for carrying heavy firewood bundles. The tensioning strap 40 is preferably long enough to carry a large firewood bundle and is more preferably at least 2 inches wide and 6 feet long so as to be suitable for emergency use by trained medical personnel as a tourniquet or sling. The tensioning strap 40 can also be used to secure crosspiece 31 and handles 21 and 22 for emergency splint use by trained medical personnel.

Figure 8:
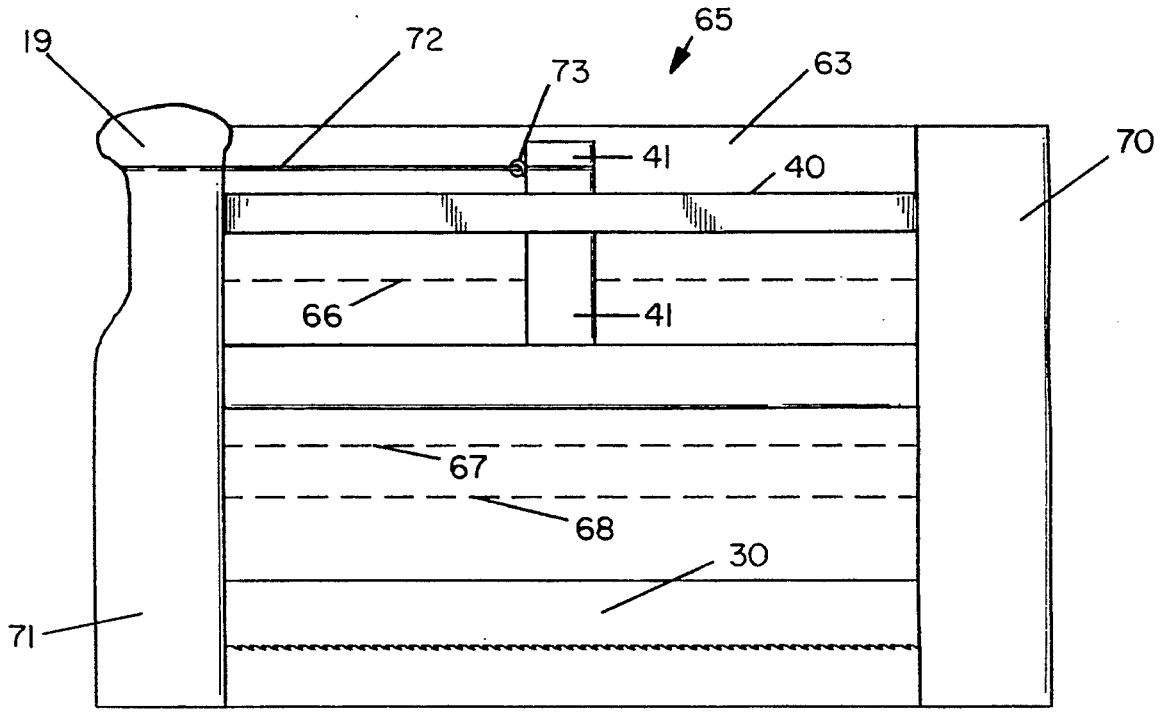
FIG. 8 is a bottom plan view of the survival saw and the carrying case combined to make the emergency survival shovel.

Referring last to FIG. 8 the emergency snow shovel 65 is shown assembled from the carrying case 63 and the survival saw 20. Carrying case 63 is preferably made of a strong, highly nonwettable material, although any material of suitable strength will suffice. Carrying case 63 is made of a double layer of fabric material. Pockets are formed by seams 66, 67, 68 and other seams (not shown) to provide individual compartments for storing the component parts of survival saw 20. Flap 70 is sewn to the carrying case 63 at the upper, lower and outer edges (seams not shown). Flap 71 is sewn to the carrying case 63 at the lower and outer edges.

In use handle 18 (not shown) is inserted into the pocket formed by flap 70 and handle 19 is inserted into the pocket formed by flap 71. The carrying case 63 is secured to the survival saw 20 by tying string 72 around tensioning rod 41 and knotting at knot 73. Emergency snow shovel 65 is particularly suited for scooping snow for emergency shelter construction.

Carrying case 63 can vary in design and be slipped over the survival saw 20 and attached to survival saw 20 by any of the many fastening means known in the art and still fall within the scope of the invention. By way of example, but not of limitation, known means of fastening include straps and buckles, snaps, zippers, buttons and tying or lacing with or without loops, grommets, eyelets and hooks. The fastening means may include holes, snaps, or other fastening means on handles 21 and 22 (not shown).

Although the present invention has been described with reference to preferred embodiments, numerous modifications and variations can be made and still the result will come within the scope of the invention. No limitation with respect to the specific embodiments disclosed herein is intended or should be inferred.

I claim:

1. A multipurpose outdoor tool comprising:

a first handle and a second handle parallel to said first handle;

said first and second handles each having an upper end and a lower end;

a crosspiece extending between said first handle and said second handle;

said crosspiece having a first end with a first extending projection, an opposing second end with a second extending projection and an upward facing hole in the middle portion of said crosspiece;

said crosspiece being beveled on the bottom;

said first handle having a hole in the middle portion;

said second handle having a hole in the middle portion;

said first extending projection fitting into said middle hole of said first handle, and said second extending projection fitting into said middle hole of said second handle;

a saw blade having a first hole at a first end and a second hole at an opposing second end;

said first handle having a first retaining pin at the side of the lower end, and having a second retaining pin at the bottom of the lower end;

said second handle having a first retaining pin at the side of the lower end, and having a second retaining pin at the bottom of the lower end;

said saw blade first hole fitting onto said first retaining pin of said first handle, and said second hole fitting onto said first retaining pin of said second handle, thereby allowing vertical mounting of the saw blade;

said saw blade first hole alternatively fitting onto said second retaining pin of said first handle and said second hole fitting onto said second retaining pin of said second handle, thereby allowing horizontal mounting of the saw blade;

tensioning strap of sufficient length to wrap around the upper end of said first handle and the upper end of said second handle;

a tensioning rod;

whereby said tensioning rod may be inserted into said tensioning strap and circularly rotated about an axis parallel to said crosspiece such that said tensioning strap twists and winds up when said tensioning rod is circularly rotated so as to pull the upper ends of said handles toward one another, thereby putting said saw blade under tension by creating a fulcrum at said crosspiece; and said tensioning rod further comprising removable engagement in said hole in said crosspiece, thereby securing said tensioning strap; and said tensioning strap further comprising a loop on one end and an opposing free end.

2. The multipurpose outdoor tool of claim 1 wherein said first retaining pin on said first handle and said first retaining pin on said second handle are mounted in outwardly leaning opposing directions and said second retaining pin on said first handle and said second retaining pin on said second handle are mounted in outwardly leaning opposing directions, thereby securely retaining the saw blade under tension.

3. The multipurpose outdoor tool of claim wherein:

said tensioning strap further comprises a length of at least three feet.

4. The multipurpose outdoor tool of claim 3 wherein said tensioning strap is at least two inches wide and six feet long.

5. The multipurpose outdoor tool of claim 1 wherein said first and second handles are beveled in an inward facing portion beneath the crosspiece and above the retaining pins.

6. The multipurpose outdoor tool of claim 1 wherein said crosspiece bevel extends to a narrow edge.

7. The multipurpose outdoor tool of claim 1 wherein said holes in said handles extend completely through said handles.

8. The multipurpose outdoor tool of claim 1 further comprising:

a carrying case for holding said component parts;

means for fastening said carrying case to said multipurpose outdoor tool;

said carrying case being slipped over and fastened to said multipurpose outdoor tool, thereby forming a tool suitable for digging and scooping snow.

9. The multipurpose outdoor tool of claim 8 wherein said means for fastening further comprises means for tying said carrying case to said multipurpose outdoor tool.

10. The multipurpose outdoor tool of claim 8 wherein said means for fastening further comprises straps and buckles.

11. The multipurpose outdoor tool of claim 8 wherein said means for fastening further comprises a strap and snap removeably fixed over said tensioning rod.

12. A multipurpose outdoor tool selectively positionable in one of an assembled working mode and a disassembled storage mode, said multipurpose outdoor tool comprising:

a first handle and a second handle;

said first and second handles each having an upper end and a lower end;

a crosspiece beveled toward the bottom;

said crosspiece having a first end with a first extending projection, an opposing second end with a second extending projection and an upward facing hole in the middle portion of said crosspiece;

said crosspiece extending perpendicular between said first handle and said second handle when said multipurpose outdoor tool is in its assembled working mode;

said first handle having a hole in the middle portion;

said second handle having a hole in the middle portion;

said first extending projection fitting into said middle hole of said first handle, and said second extending projection fitting into said middle hole of said second handle when said multipurpose outdoor tool is in its assembled working mode;

saw blade having a first hole at a first end and a second hole at an opposing second end;

means for mounting said saw blade to said lower ends of said first and second handles in a vertical position or alternatively in a horizontal position when said multipurpose outdoor tool is in its assembled working mode;

a tensioning strap of sufficient length to wrap around the upper end of said first handle and the upper end of said second handle when said multipurpose outdoor tool is in its assembled working mode; a tensioning rod;

said tensioning rod positionable into the middle portion of said tensioning strap when said multipurpose outdoor tool is in its assembled working mode such that said tensioning strap twists and winds up when said tensioning rod is circularly rotated about the long axis of said tensioning strap so as to pull the upper ends of said handles toward one another, thereby putting said saw blade under tension by creating a fulcrum at said crosspiece;

said tensioning rod further comprising removable engagement in said hole in said crosspiece, thereby securing said tensioning strap;

a carrying case for holding said multipurpose outdoor tool when said multipurpose outdoor tool is in the disassembled storage mode;

said carrying case further comprising means for fastening said carrying case to said multipurpose outdoor tool in the assembled working mode such that said assembled multipurpose outdoor tool can be placed in the carrying case and secured, thereby forming a tool suitable for digging and scooping snow.

13. The multipurpose outdoor tool of claim 12 wherein said means for fastening further comprises means for tying said carrying case to said multipurpose outdoor tool.

14. The multipurpose outdoor tool of claim 12 wherein said means for fastening further comprises straps and buckles.

15. The multipurpose outdoor tool of claim 12 wherein said holes in said handles extend completely through said handles.

16. The multipurpose outdoor tool of claim 12 wherein said crosspiece bevel extends to a narrow edge.

17. The multipurpose outdoor tool of claim 12 further comprising:

said tensioning strap further comprising a loop on one end and an opposing free end;

said opposing free end further comprising removable insertion through said loop to make a sling; and said tensioning strap further comprising a length of at least three feet.

18. The multipurpose outdoor tool of claim 17 wherein said tensioning strap is at least two inches wide and six feet long.

19. The multipurpose outdoor tool of claim 12 wherein said means for mounting further comprise a first retaining pin at the side of the lower end of said first handle and a first retaining pin at the side of the lower end of said second handle which fit respectively into said first and second holes of said saw blade, thereby allowing vertical mounting of said saw blade, and further comprise a second retaining pin at the bottom of the lower end of said first handle and a second retaining pin at the bottom of the lower end of said second handle which fit respectively into said first and second holes of said saw blade, thereby allowing horizontal mounting of said saw blade.

20. The multipurpose outdoor tool of claim 19 wherein said first retaining pin on said first handle and said first retaining pin on said second handle are mounted in outwardly leaning opposing directions and said second retaining pin on said first handle and said second retaining pin on said second handle are mounted in outwardly leaning opposing directions, thereby securely retaining the saw blade under tension.

* * * * *